United States Patent [19]

Calkins

[11] Patent Number: 4,577,645

[45] Date of Patent: Mar. 25, 1986

[54] REDUCED MOISTURE SMOKER'S PIPE

[76] Inventor: Edward H. Calkins, 333 E. Main St., Gaylord, Mich. 49735

[21] Appl. No.: 331,316

[22] Filed: Dec. 16, 1981

Related U.S. Application Data

[63] Continuation-in-part of Ser. No. 213,725, Dec. 5, 1980, Pat. No. 4,362,169.

[51] Int. Cl.[4] ..... A24F 5/00; A24F 5/04; A24F 7/02

[52] U.S. Cl. ..... 131/196; 131/198 R; 131/198.1; 131/201; 131/204; 131/222; 131/227; 131/229; 131/220; 131/226

[58] Field of Search ..... 131/220, 196, 226, 198 R, 131/198 A, 201, 204, 222, 227, 229

[56] References Cited

U.S. PATENT DOCUMENTS

| | | | |
|---|---|---|---|
| 1,627,605 | 5/1927 | Homan . | |
| 1,756,695 | 4/1930 | Lucas . | |
| 2,251,545 | 8/1941 | Munzer | 131/196 |
| 2,373,592 | 4/1945 | Orrington | 131/196 |
| 2,534,476 | 12/1950 | Plesh | 131/196 |
| 2,718,892 | 10/1949 | Holderman . | |
| 3,028,867 | 6/1960 | Calkins . | |
| 3,091,246 | 5/1963 | Mahieux | 131/196 |
| 3,185,163 | 8/1963 | Buckingham . | |
| 3,292,639 | 6/1964 | Zarikta . | |
| 3,422,821 | 1/1969 | Calkins | 131/196 |

FOREIGN PATENT DOCUMENTS

| | | | |
|---|---|---|---|
| 58255 | 1/1891 | Fed. Rep. of Germany . | |
| 360466 | 4/1906 | France . | |
| 969802 | 7/1948 | France | 131/222 |
| 24471 | of 1896 | United Kingdom . | |
| 203919 | 9/1923 | United Kingdom . | |
| 264914 | 1/1927 | United Kingdom . | |

*Primary Examiner*—V. Millin

*Attorney, Agent, or Firm*—Larson and Taylor

[57] ABSTRACT

An improved smoker's pipe of the dry bowl type. The pipe is comprised of a hollow stem having a mouthpiece mounted at one end and a bowl assembly mounted at the other end. In one embodiment of the pipe the bowl assembly includes an outer bowl removably mounted on the stem and concentrically spaced around an inner, combustion bowl. The outer bowl has an upper cylindrical portion and a lower skirt portion with a notch therein for removably receiving the stem portion. The combustion bowl has a lower, centrally located vertical smoke hole in communication with a short, longitudinally extending passageway located below the smoke hole. The passageway is in fluid communication with the stem and its short length results in minimal fluid accumulation therein.

25 Claims, 10 Drawing Figures

REDUCED MOISTURE SMOKER'S PIPE

CROSS-REFERENCE TO RELATED APPLICATION

This is a continuation in part application of U.S. patent application Ser. No. 213,725 filed Dec. 5, 1980, now U.S. Pat. No. 4,362,169, issued Dec. 7, 1982, which is expressly incorporated herein.

BACKGROUND OF THE INVENTION

1. Field of the Invention

The present invention relates generally to smoker's pipes, and more particularly, to a new and improved smoker's pipe of the dry bowl type using auxiliary and cooling air flows.

2. Description of the Prior Art

Conventional pipes, including filtered pipes and those equipped with metal fittings which form condensation and taint flavor, function today the same way they have for centuries. A single channel, closed at the heel end, connects the bowl, shank, stem and bit. Liquids generated while smoking run down this single channel and build up in the heel of the bowl. Filters and fittings in the smoke channel slow or modify the process, but eventually the liquids will enter the bowl and will be absorbed by the tobacco. This condition generally continues until about one-fourth of the tobacco in the lower bowl becomes saturated with collected liquids.

When the burning tobacco in the upper part of the bowl reaches the saturated tobacco in the lower bowl, combustion is gradually reduced as the degree of wetness increases, and the condition becomes akin to that of trying to burn wet leaves. From this level downward, the flavor supporting carbon cake built up on the inner walls of the pipe begins to disintegrate and disappear. Moreover, the heat of descending combustion above this level progressively increases the temperature of the confined liquids, causing excessive heat and accelerating the absorption of contaminants.

These circumstances sustain the development of foul odors and bad taste. In addition, the smoke must pass through this collection of hot, acrid condensate producing a biting sensation on the smoker's tongue.

In my U.S. Pat. No. 3,028,867, a dry bowl pipe is disclosed wherein the bowl and stem are integrally molded of plastic material, and wherein the stem has an additional passage within which a cartridge of absorbant material is disposed so as to collect the liquid combustion products and efficiently remove them from the smoke path. The absorbant cartridge has an outer end screwed into a threaded bore in the front end portion of the stem below the bowl. The tobacco has a flattened nipple whereby it can be grasped exteriorally of the pipe to insert and remove the cartridge which has an axially bored inner end to receive a tube which is fitted in a bore in the mouthpiece. The tube has a radial aperture in its side wall so as to provide a smoke path from the burning tobacco in the bowl to the smoker's mouthpiece.

An improved dry bowl pipe is disclosed in my U.S. Pat. No. 3,422,821 wherein the bowl assembly is composed of an outer bowl of plastic and an inner bowl of ceramic material. The inner surface of the outer bowl is formed with a plurality of narrow vertical ribs that engage the inner bowl and hold it spaced from the outer bowl while creating a plurality of air grooves whereby air can flow over the inner bowl for cooling.

The inner bowl is held in place by a resilient metal split washer which is seated on the upper end of the inner bowl under an annular clamping ring that is screwed into the internally threaded upper end of the outer bowl in engagement with the split washer.

Pipes formed in accordance with my aforesaid patents, have been well received by smokers. They function extremely well to provide a smooth, cool smoke without the foul taste attendant to the operation of conventional smoker's pipes. However, the pipes are somewhat expensive to fabricate because of special structural details including the vertical ribs between the inner and outer bowls, the manner of joining the nner and outer bowls together, and the manner of mounting the absorber cartridge.

However, pipes having an inner bowl of a ceramic material develop a serious problem whereby moisture travels transversely through the ceramic bowl and accumulates as droplets on the outer side thereof. In addition, the pipes smoke "raw" until a layer of carbon is built up on the inside surface, a process that could take several days or even weeks.

SUMMARY OF THE INVENTION

As stated in the parent application, it is an object of the disclosed invention to provide a dry bowl pipe which possesses all of the advantages of the pipes of my earlier patents while being less costly to fabricate on a mass production basis and providing an even smoother, cooler smoke.

Another object of that invention is to construct a dry bowl pipe in which smoke from the burning tobacco is passed first through a cooling passage in the bottom of the bowl, is mixed with a metered fresh air flow then is passed to a cooling chamber, and then to a final cooling cluster in the mouthpiece.

The present invention has a further object in the construction of a smoker's pipe having a ceramic inner bowl and a plastic, snap-on outer bowl separated by a surrounding cooling passage wherein protruding exits are formed on the bottom of the inner bowl at ends of a passageway longitudinally extending below the combustion chamber so as to supply the smoke directly to a cooling chamber without contacting any intermediate members and to provide a mechanical mounting and sealing means.

A further object of this invention is to construct a dry bowl smoker's pipe in which smoke and liquid components are kept entirely separate throughout the entire pipe assembly.

The present invention has yet another object in maintaning the tobacco charge completely dry from the top to the bottom of the bowl so as to maintain uniform quality of the smoke and uniform combustion, enhancing carbon-cake build-up over the entire inner bowl wall.

A further object of this invention is to construct a smoker's pipe which is self-supporting in an upright position and has cooling air channels which remain open even when the pipe is resting on a flat surface.

In addition, the present invention in one embodiment thereof incorporates a ceramic bowl having porous inner walls and non-porous glazed outer walls and glazed smoke passageways. The glazed surfaces permit easy cleaning and prevent moisture from travelling through the wall and droplets forming on the outside.

The porous inner wall permits a tightly adhering pyrolyzed inner carbon layer to be formed thereon.

The present invention exhibits numerous advantages over conventional and dry bowl pipes of the prior art. Significant among these advantages are the development of a smooth, uniform and cool smoke; the addition of cooling air to the hot smoke; the separation by an air cooling chamber of inner and outer bowls so as to maintain the outer surface of the pipe cool to the touch; the provision of enhanced air cooling and the maintenance of the cooling flow even when the pipe is placed at rest on a flat surface; imporved moisture separation; the elimination of contaminated liquids from the smoke flow passage; and the development of a dry bowl pipe which may be economically produced using mass production techniques.

Other objects and advantages of the present invention are described in or will become apparent from the following detailed description of a preferred embodiment when taken in conjunction with the accompanying drawings.

DESCRIPTION OF THE PREFERRED EMBODIMENT

Figure 2:
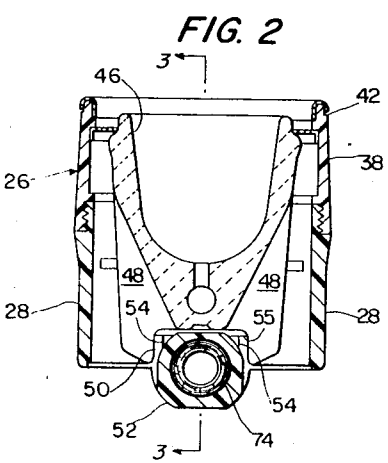
FIG. 2 is a transverse sectional view of the pipe bowl taken along line 2—2 of FIG. 1.
Figure 1:
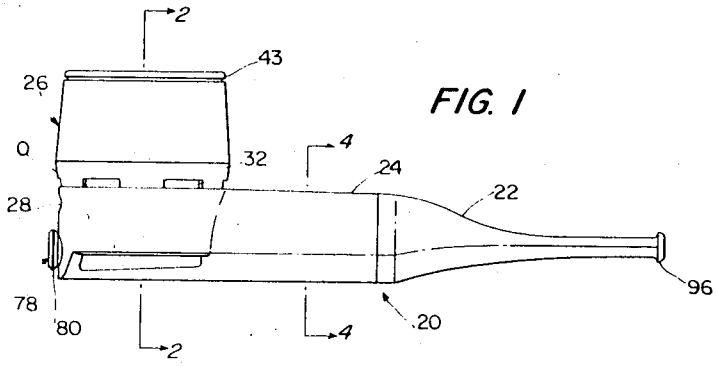
FIG. 1 is a side elevational view of a preferred embodiment of an improved air insulated dry bowl pipe according to the present invention.
Figure 3:
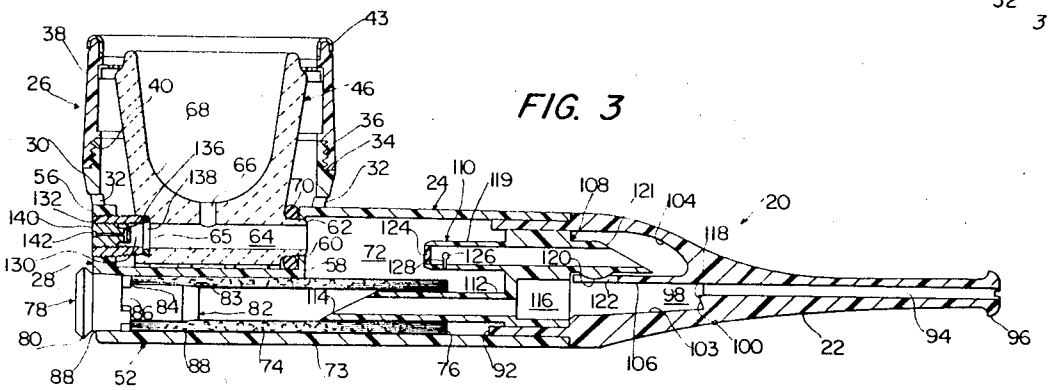
FIG. 3 is a longitudinal sectional view of the pipe of FIG. 1, taken along line 3—3 of FIG. 2.

Referring now to the drawings in which numerals refer to like elements in the several views, and initially to FIGS. 1-3, there is a shown smoker's pipe 20 having a mouthpiece 22 which is removably attached to a stem 24 provided with a bowl assembly 26. The bowl assembly 26 includes a generally cylindrical, hollow base ring 28 on which is mounted an annular collar 30 having a plurality of air passage openings 32. Collar 30 has an upper end that is inwardly offset so as to form a shoulder 34 and has exterior threads 36.

A generally cylindrical outer bowl 38 is provided with interior threads 40 (FIG. 5) for cooperation with threads 36 of the collar 30. For esthetic reasons, bowl 38 could also have a conical shape. An outwardly directed flange or lip 42 at the upper end of the outer bowl 38 receivingly mounts a protective metal ring 43.

A ceramic inner bowl 46 is mounted inside base ring 26 spaced concentrically from outer bowl 38. An annular metal screen 47 extends between outer bowl 38 and inner bowl 46 and prevents tobacco and other foreign objects from falling therein and lodging therebetween. Screen 47 also serves as a heat shield to convey heat away from the top of inner bowl 46. Preferrably, screen 47 is retained inside outer bowl 38, abutting the lower end of metal ring 43, by being force fitted therein.

Figure 5:
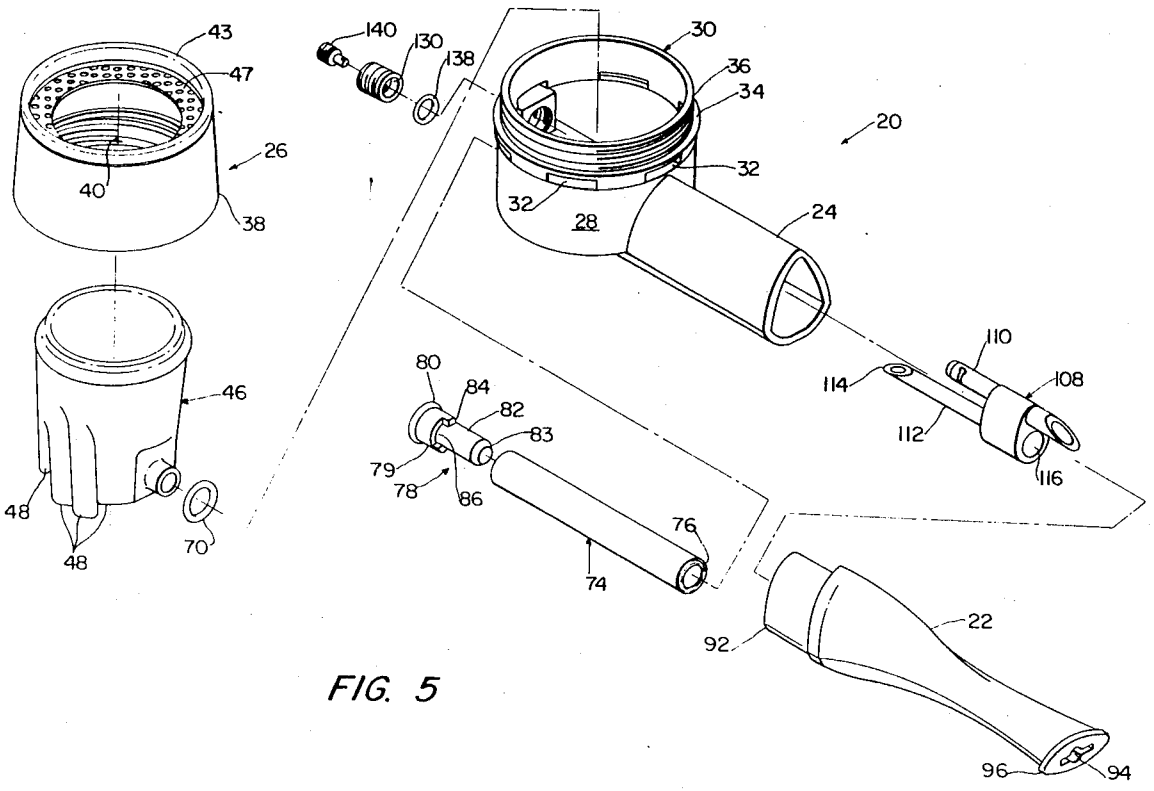
FIG. 5 is an exploded perspective view of the pipe of FIG. 1.

As can be appreciated from FIGS. 2 and 5, inner bowl 46 contains a plurality of cooling fins 48 at the bottom end thereof. Each of the cooling fins 48 extends downwardly from the main portion of the inner bowl 46 and defines a central notch or cut-out 50 for receiving a generally rectangular support shank 52 extending longitudinally within the stem 24. The side walls of shank 52 are curved inwardly as shown in FIG. 3 at the mid portion thereof and two pairs of integral supports 54 are located at each end thereof for receiving the corresponding ends 55 at the bottom of inner bowl 46. Thus, cooling fins 48 extend around support shank 52 and the bottom of inner bowl 46 is spaced above the top of support shank 52. As a result of this construction, air flow passageways are provided between the cooling fins 50 and around the top of shank 52 between supports 54. All of this structure serves to maintain the temperature of the inner bowl 46 at a reduced level for the comfort of the smoker.

The generally cylindrical, hollow base ring 28 extends around support shank 52 in the area where the inner bowl is seated. Base ring 28 crosses the longitudinal center line of the pipe at a front wall 56 and a rear wall 58 (see FIG. 3). Rear wall 58 is provided with a circular opening 60 through which a protruding nipple 52 of the inner bowl 46 extends. Coaxial with nipple 62 is a smoke passageway or bore 64 which extends longitudinally and horizontally across the bottom of and completely through inner bowl 46 in the area of the cooling fins 48 and terminats in an enlarged front opening 65 in inner bowl 46. Miway in passageway 64 and communicating therewith is a downwardly extending vertical passageway 66 which communicates with the interior of inner bowl 46 as shown. As can be seen in FIG. 3, the bottom of inner bowl 46 has slightly sloped sides 68 symmetrically converging on the centrally located vertical passageway 66, which serves to direct the advancing combustion toward the passageway 66 and to provide even burning.

Protruding nipple 62 can be formed as an integral part of inner bowl 46 or can be provided by inserting a separate tube or sleeve within an appropriate bore in the bottom of the bowl. The separately inserted tube or sleeve can be attached to inner bowl 46 in any suitable manner so as to provide an air-tight, integral assembly. Alternatively, nipple 62 can be omitted entirely and replaced with a recessed area about the outer opening for positionably receiving a thicker O-ring seal that would also sealingly engage rear wall 58. However, protruding nipple 62 does provide a means for mounting and aligning inner bowl 46 inside outer bowl 38.

A washer or O-ring 70 is disposed around nipple 62 between rear wall 58 and the outer side surface of inner bowl 46. O-ring 70 may be made of any suitable heat-resistant material which will form an air-tight seal between inner bowl 46 and the shank of pipe 20. A washer constructed of aluminum or Teflon is particularly well suited for this application although it should be appreciated that any number of different materials could be used. At this point, it is noted that nipple 62 protrudes slightly beyond the inner side of rear wall 58 so as to carry the exiting smoke well into an enlarged cooling chamber 72 in stem 24 without having the smoke pass through any intermediate members or come into contact with any other portions of the assembly. This minimizes the exposure of the smoke to contaminants and assures that any liquid condensate which may develop around nipple 62 falls clear of the rearward end thereof without leaking around opening 60 and onto O-ring 70.

Referring to FIGS. 2 and 3, it can be appreciated that the bottom of base ring 28 terminates above the level of the bottom of shank 52 and that shank 52 preferably has a flat bottom wall 73. In this manner, open air flow passages are established from the bottom to the top of bowl assembly 26 between the outer and inner bowls 38 and 46 thereof. Screen 47 at the upper end of the outer bowl 38 also defines an annular air passage opening so as to allow the air flowing upwardly by convection to exit around the inner bowl 46. The upward flow of air is further enhanced by the presence of the intermediate air openings 32 formed in collar 30.

Collar 30 and cylindrical member 28 may be made as a single molded member or may be formed separately and integrally joined by welding, by adhesives or by any other suitable technique. Stem 24, collar 30, and outer bowl member 38 are preferably formed from plastic engineering resins or plastic materials having desired impact resistance and toughness, and capable of maintaining their properties over a wide temperature range. Typical of these are the polycarbonate resins (such as "Lexan," a product of General Electric Company), and an even better thermoplastic polyester, polybutylene terephthalate (PBT) (such as "Valox" PBT, a product of General Electric Company). Other plastics include the high performance, high strength polysulfones, (such as "Udel," a product made by the Union Carbide Company), the oxymethylene polymers and copolymers, acrylic polymers and copolymers, and other high strength, high impact and thermally stable polymers and plastics.

Inner bowl 46 is preferably formed from refractory ceramic materials capable of withstanding sharp changes in temperatures, resisting abrasion, and having desirable heat capacity. Typical are the refractory materials made of kalonite, silicon carbide, zirconia, fire clay, dolomite, carbon, sillimanite, and the like. The bowl can also be formed from meerschaum or may be made from a good quality briar or other suitable wood.

A presently preferred embodiment of inner bowl is made of a conventional mechanical porcelin, such as koalin clay from Georgia. The outside of inner bowl 46 and all of the walls defining horizontal passageway 64 are glazed. These glazed ceramic portions not only made bowl 46 non-porous to prevent moisture penetrating therethrough, but also provide surfaces that are easily washable and, of particular importance in passageway 64, will not absorb any of the liquids that accumulate from smoking.

A presently preferred embodiment of inner bowl 46 also utilizes a pyrolyzed inner carbon layer formed from a substance having a high carbon content. Preferably substances are those with a high sugar content and in a fluid state. The presently preferred sugary substance is ordinary bee's honey of any commercial variety. Other sugary substances are sugar syrup (sugar and water), corn syrup, maple syrup, molasses, or a mixture of the foregoing.

The pyrolyzing process is critical because if improperly done, the coating could either not adhere properly, on the one extreme, or be completely burnt off, on the other extreme. A presently preferred process is as follows. After inner bowl 46 has been shaped and fired, it is cooled. Also, the inner surface is roughened up, such as with an abrasive, to increase the porosity. The inner surface is then completely coated with a thin layer of a sugary substance, such as honey, and the bowl is placed in a heated environment. Preferably, the bowl is placed for a few minutes, such as 4 to 9 minutes, on a heated surface located in an open space that is at atmospheric temperature and pressure. The bowl is then removed and left to cool naturally in an atmospheric temperature and pressure environment.

In one example, the inner surface of an unfired bowl was manually roughened up using water, was fired, and a commercial grade of honey was applied with a conventional paint brush to completely cover the roughened inner surface of the bowl. The bowl was then placed on a heated calrod unit of a conventional electric stove for about 6 minutes. The stove was in an open room at about 70° F. at atmospheric pressure and the burner unit heat control was on the "HIGH" setting. A temperature measurement of the burner revealed that the burner was at about 1,500° F.

In another example, the above process was repeated, but a loosely fitted cover having vent holes in the horizontal surface top that permitted ample natural ciculation underneath the bottom sides and around the bowl was placed over the bowl without touching it during the last 2 to 3 minutes of the 6 minute heating step. This step resulted in an effective, even pyrolysis of the upper inner surface of the inner bowl.

In a further embodiment, a greater porosity of ceramic inner bowl 46 can be obtained by adding finely pulverized sawdust to the green clay mix before firing. The mix is then molded and the molds are fired in a conventional way using a conventional kiln. The firing burns away the sawdust leaving a porosity proportionate to the quantity of sawdust particles in the mix. An examplary amount of sawdust added is 20% by volume of the final composition. The bowls can then be coated with a conventional glaze and refired to produce the final glazed porcelin inner bowl 46. Such a bowl will have a porous inner portion and an outer, blazed nonporous surface. The porous inner bowl portion promotes the build up of the inner carbon cake. A more porous inner bowl 46 also has the advantage of being lighter in weight.

If desired, the plastic materials used in connection with the present invention may contain various siliceous fillers, including $SiO_2$, fiberglass re-enforcing fillers, and the like. Other non-metallic refractory materials which may be used herein are the borosilicate glasses of the "Pyrex" type.

The pipe 20 according to the present invention includes an assembly for preventing liquids, such as those that condense from the smoke or come from the mount of the smoker, from gaining access to the inner bowl 46 or the tobacco therein so that the inner bowl remains relatively dry whereby the tobacco burns freely and substantially evenly and completely. This assembly includes an elongated, hollow, flexible absorbent tube 74 formed from convolutions of paper, like a conventional drinking straw, which may be provided with minute perforations through the wall thereof, if desired. A wrapping of suitable thermoplastic material 76, such as polyethylene, surrounds the tube like a matrix section surrounding a core section. One end of absorbent tube 74 is mounted on a plug 78 that comprises an enlarged head 79 with a terminal flange 80 and a smaller, cylindrical body 82 having an outer diameter sized to be frictionally received inside absorbent tube 74. The distal end 83 of plug body 82 is tapered to permit easier insertion into absorbent tube 74 and plurality of integral lugs 84 extend longitudinally from head 78 along body 82 a short distance. Slots 86 are thereby provided between lugs 84 for preventing pressure build-up within the interior of tube 74 and permitting liquids to travel around the end and be absorbed by the inner end layers of absorbent tube 74. In this way, advancing liquids flowing toward tube 74 are not retarded in any way during the use of pipe 20.

Support shank 52 of pipe stem 24 is formed with a bore 88 (FIG. 2) within which plug 78 and absorbent tube 74 are mounted. The outer diameter of absorbent tube 74 is somewhat less than the diameter of bore 88 so that absorbent tube 74 is freely admitted therein, and the diameter of plug head 79 is sized and tapered to frictionally fit within bore 88 to maintan plug 78 and attached absorbent tube 74 in place. Plug flange 80 overlies the front end of bore 88 and is provided so as to enable plug 78 to be easily inserted into and removed from bore 88. In addition, flange 80 and tapered plug provide an airtight head seal at the front end of bore 88. Thus, absorbent tube 74 and plug 78 can be easily removed and absorbent tube 74 replace with a fresh assembly it becomes overly contaminated with liquids, tars or other contaminants.

Figure 4:
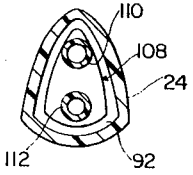
FIG. 4 is a transverse sectional view taken along line 4—4 of FIG. 1.

As can be appreciated from FIGS. 4 and 5, stem 24 is oral or tear-drop shaped as is the coupling end 92 of mouthpiece 22. The coupling end 92 has an outer dimension matched with the inner dimension of stem 24 such that the mouthpiece may be frictionally slid into place or removed for cleaning. Mouthpiece 22 has a longitudinal bore 94 therein which extends from the bit end 96 into a second phase cooling chamber 98. Chamber 98 is formed by a bore having a first rear wall 100 from the end of bore 94 to the bottom 102 thereof. A second, circular, rear wall 104 is formed above bore 88 and is separated therefrom by a partition 106.

Disposed within the end of mouthpiece 22 adjacent chamber 98 is a removable cluster ssembly 108 containing a smoke passage tube 110 and a liquid tube 112. Liquid tube 112 extends toward the front or bowl end of pipe 20 and has an inclined end 114 that is adapted to be received within the other end of absorbent tube 74, as shown in FIG. 3. The other end of liquid tube 112 opens onto a compartment 116 which communicates with chamber 98 and bottom 102. Bottom 102 is preferably inclined downwardly from mouthpiece 22 towards cluster assembly 108 so that any liquids that collect tend to drain down toward the inclined end 114 of liquid tube 112 where they are absorbed by absorbent tube 74. First rear wall 100 meets bore 94 at a relatively sharp lip 118 which has the effect of preventing any liquids from running back up bore 94 to bit end 96.

Smoke passage tube 110 extends approximately equally on both sides of cluster 108 having an upstream portion 119 disposed within first phase cooling chamber 72 and a downstream portion 121 disposed within second phase cooling chamber 98 adjacent second rear wall 104. A depending boss 120 is formed along part of the bottom of downstream portion 21 of tube 110 and partition 106 is bifurcated by a slot 122 which together provide a passageway through which the smoke may pass. As can be appreciated from FIG. 3, the design of smoke passage tube 110, rear wall 104, boss 120, and partition 106 with slot 122 results in the smoke passing through smoke tube 110 and then curving around through slot 120 into the lower portion of cooling chamber 98 and then curving around once again whereupon it passes through bore 94. The smoke thus is constrained to traverse an S-shaped flowpath which develops some turbulence and quite effectively promotes cooling and moisture separation.

As shown in FIGS. 3 and 5, an end closure or plug 24 is located in the forward end of smoke tube 110 and tube 110 is provided with two aligned side orifices 26. A transverse bottom slot 128 can extend upwards into the bottoms of orifices 126 to connect them to provide one flow or can be eliminated so as to require the smoke to divide into two paths. End closures 124 prevents any liquids from accumulating in smoke tube 110 and cooling chamber 98 from being blown into bowl horizontal passageway 64 during a reverse air blast applied at bit end 96 by the smoker. In this case, the length of partition 106 can be substantially reduced or removed to prevent excessive moisture accumulation and slot 122 eliminated. However, comparable smoke curving is still retained as a result of the smoke having to enter tube 110 through orifice 126.

As mentioned above, bowl horizontal passageway 64 extends longitudinally completely through inner bowl 46 and terminates in enlarged front opening 65. Coaxially aligned with opening 65 when inner bowl 46 is mounted in bowl assembly 26 is a threaded orifice 132 in base ring front wall 56 that is also located directly above bore opening 88. Orifice 132 receives an externally threaded barrel screw 134 having a threaded bore 136 therethrough. The forward end of barrel screw is provided with a slot (not shown) so it can be screwed into orifice 132. The rearward end of barrel screw sealingly engages an O-ring 138 mounted in inner bowl front opening 65. An externally threaded jet plug 140 mates with and is received by threaded bore 136 of barrel screw 134. Jet plug 140 has an internal T-shaped bore 142 therein, the transverse section of bore 42 being located in the rearward portion thereof and the forward portion being in communication with the air outside pipe 20. Terminal end surface 144 of plug 140 has a concave shape. By its construction, jet plug 140 breaks up the incoming fresh air and causes it to be sprayed into horizontal passageway opening 65. This permits faster and gentler mixing of the fresh air with the smoke and prevents rapid breakup and resulting condensation of the smoke that would result if the fresh air were admitted as a solid stream.

Inner bowl 46 is rigidly attached inside outer bowl 38 solely by barrel screw 134 forcing the rearward side of bowl 38 into a retaining engagement with rear wall 58 of base ring 28. As mentioned above, supports 54 support bowl ends 55 to provide vertical and transverse stability.

The dimensions and volumes of the various fluid passageways, bores, and chambers is very important and very critical. For example, if the relative sizes of bores 94, chambers 98 and 72, and passageway 64 are not chosen properly, then the pipe either will draw too quickly with improper cooling of the smoke and too rapid burning of the tobacco (passageway 64 being large relative to chambers 98 and 72 or chambers 98 and 72 being too small), or will be too hard to draw (chambers 98 or 72 being too large relative to bore 94 or passageway 64, respectively, causing a large pressure drop at the respective junctions). In a conventional pipe, such as depicted in U.S. Pat. No. 3,185,163, incorporated herein by reference, the bore in the bit is approximately the same diameter ( about 0.125 inches) as the bores in the shank and into the bowl. Thus the pressure drop from the bowl to the shank bore is about the same as the pressure drop cross the bit. In the present invention, there is a relatively large chamber 72 in the smoke passage. Chamber 72 does not cause any drawing problems if the ratio of the diameters of passageway 64 (about 0.280 inches) and bore 94 (about 0.125 inches) is between about 1.8 to about 2.5 with a presently preferred ratio being about 2.25. The function of the draw degrades significantly the closer the two diameters approach each other in size.

Similarly, there is a pressure drop from bowl horizontal passageway 64 to bowl vertical passageway 66. Too large a vertical passageway 66 and tobacco will drop therein or the tobacco will burn too hot and too quickly. An ideal diameter of vertical passageway 66 was experimetally found to be 0.125 inches. This is the same size as bit bore 94. Also, it was found that if the inner sides of inner bowl 46 do not converge symmetrically on vertical passageway 66, dottle forms in the bowl and the tobacco does not burn completely.

An optimum size for chamber 72 was experimentally found to have a height of 0.725 inches and a cross-section of 0.500 inches. Thus, the desired draw is achieved when chamber 72 size is much, much larger than either bore 94, passageway 64 or passageway 66.

The present invention, as mentioned above, provides a relatively large diameter bowl horizontal passageway 64 and the approximately same size inner barrel screw bore 136. This permits easy cleaning of passageway 64 from the bowl end (e.g. with a brush) without having to remove inner bowl 46.

The smoke is initially cooled when it comes into contact with the fresh air stream emitted into bowl horizontal passageway 64 through the jet plug bore 142. Obviously the diameter of bore 142 is also critical—too large a bore and the smoke will be too lean and too small a bore and the smoke will have insufficient cooling. Through experimentation, it was found that a bore 142 having a diameter from about 0.020 inches to about 0.050 inches, with a presently preferred range of 0.030 to 0.036 inches, works best with a bore of 0.036 and a vertical bore 66 of 0.140, the air is about 25% of the mixture.

The fresh air addition at the front bottom of inner bowl 46 cools the smoke earlier, keeps the bottom of bowl 46 cooler, reduces the temperature differentials throughout pipe 20, and reduces condensation buildup around inner bowl 46. Condensation is the worst problem in a pipe of the present type. It develops anywhere in the system where there is an air leak or where there is an obstruction, such as a small particle of tobacco caught in any of the passages of the smoke stream flow. Wetness anywhere in the system causes bite and condensation obviously causes wetness. Proper calibration of the length and diameter of the various smoke passages is necessary to reduce condensation outside chamber 98 and compartment 116. A principal location of early condensation is in horizontal passageway 64 between vertical passageway and the end of nipple 62. Passageway 66 could be located closer to nipple 62, but that has the aforementioned disadvantages. Another solution is to have horizontal passageway 64 on a slight rearward and downward slope to take advantage of gravity to carry the condensation to chamber 72. A 7 degree down angle is believed to be satisfactory. Another solution is to provide a countersunk rearward opening in place of nipple 62, thereby shortening passageway 64.

Pipe 20 in a further embodiment can also include and opening in the side of stem 24 near the rearward end thereof to provide a means for feeding outside air into the first phase cooling chamber 72. The size of the opening is critical and therefore it is designed to receive a plug having a small, metered opening therethrough for precise control of outside air flow. The plug may be press fit or threaded into the opening and, depending upon the smoker's preference, any number of plugs having different size openings can be selected and installed to produce a full flavored smoke (when the plug has a small opening or no opening at all) or a light smoke (when the plug has a relatively large opening).

It can be appreciated that the inner bowl 46 is provided with at least five separate systems for maintaining the bowl at a relatively cool temperature. First, the bowl is cooled by convection air flowing upwardly through the annular space between it and outer bowl 38. Second, cooling fins 48 are positioned in the air flow path to dissipate heat from the lower end and screen 47 abuts the upper end to further dissipate heat. Third, the upward air circulation is enhanced by the intermediate vents or openings 32 in base ring 28. Fourth, a longitudinal cooling flow path is provided by notch 50 which runs directly parallel to the smoke passageway 64 within the bowl. Five, fresh air is admitted to the forward end of horizontal passageway 64 where it both cools the smoke and the bottom of bowl 46. All of these features cooperate to keep inner bowl 46 cool and to prevent outer bowl 38 from becoming uncomfortable to the touch.

Once the smoke passes through horizontal passageway 64 and out through nipple 62, it then enters the first phase cooling chamber 72. In this chamber, the smoke flow is generally turbulent so that considerable heat is given off as the smoke passes out from nipple 62 to the inlet end of smoke passage tube 110. Once the smoke passes through smoke tube 110, it then enters the second phase cooling chamber 98 where it is constrained to flow about the S-shaped smoke passage discussed above. The smoke, having thus been cooled successively as it travels from the combustion bowl to the bit end of mouthpiece 22, is now at a comfortable temperature for the enjoyment of the smoker.

While the smoke is passing through the successive cooling phases, various liquids present in the system are being collected within liquid absorbent tube 74. Condensate liquids which may collect about nipple 62 of inner bowl 46 will be absorbed as they drop down onto the outside of absorbent tube 74. More importantly, however, the greater volume of liquid which generally drains down from the smoker's mouth into the pipe will be fed through bore 94, over lip 118, across bottom 102, and through liquid tube 112 to the interior of absorbent tube 74. As mentoned above, lip 118 prevents these liquids from flowing back into the mouthpiece as the smoker draws on the pipe so that the liquids are entrapped and ultimately totally absorbed by absorbent tube 74.

All of the various portions of pipe 20 constructed in accordance with the present invention can be made of a suitable molded plastic material with the exception of the inner bowl 46 and the absorbent tube 74. Thus, pipe 20 can be manufactured quite economically and can be mass produced with little difficulty.

Because inner bowl 46 according to the present invention is a separate unit which can be easily replaced by merely unscrewing outer bowl 38, and barrel screw 134 the smoker may desire to purchase several different inner bowls which may be made of the same material or different materials. These bowls may be easily changed so that the smoker can enjoy several smokes without having to use the same bowl over and over again. Of course, because of the unique ability of the present invention to maintain liquids separate from the bowl, the necessity to "dry out" the pipe after each smoke is not nearly as great as it is with the conventional pipes.

Figure 6:
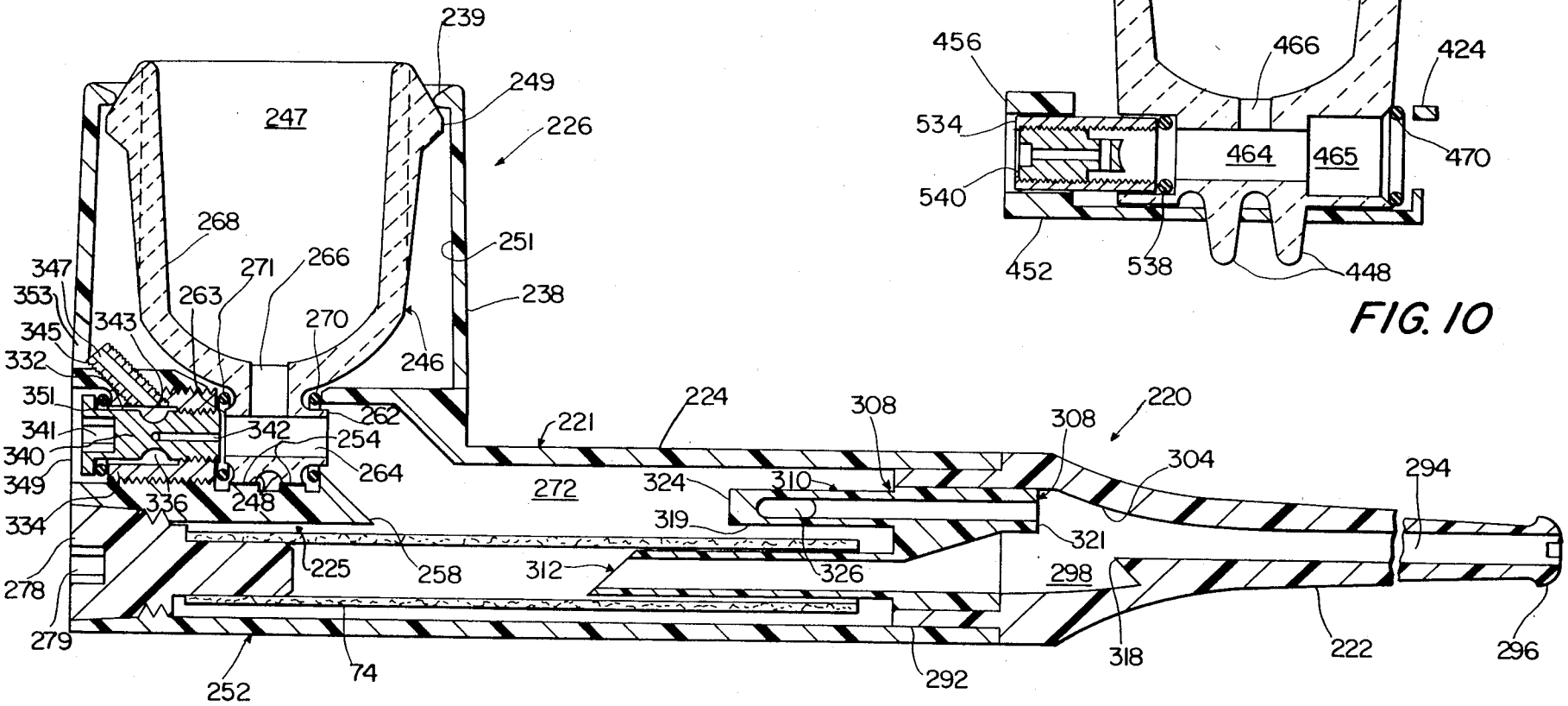
FIG. 6 is a longitudinal sectional view of a further embodiment of the present invention.

Referring now to FIG. 6, an improved version of pipe 20 is depicted. This improved version is denoted to 220 and subsequent numbers which refer to elements that are similar to elements in pipe 20 will have a numerical designation that is 200 greater than the numerical designation of the elements in pipe 20.

Figure 7:
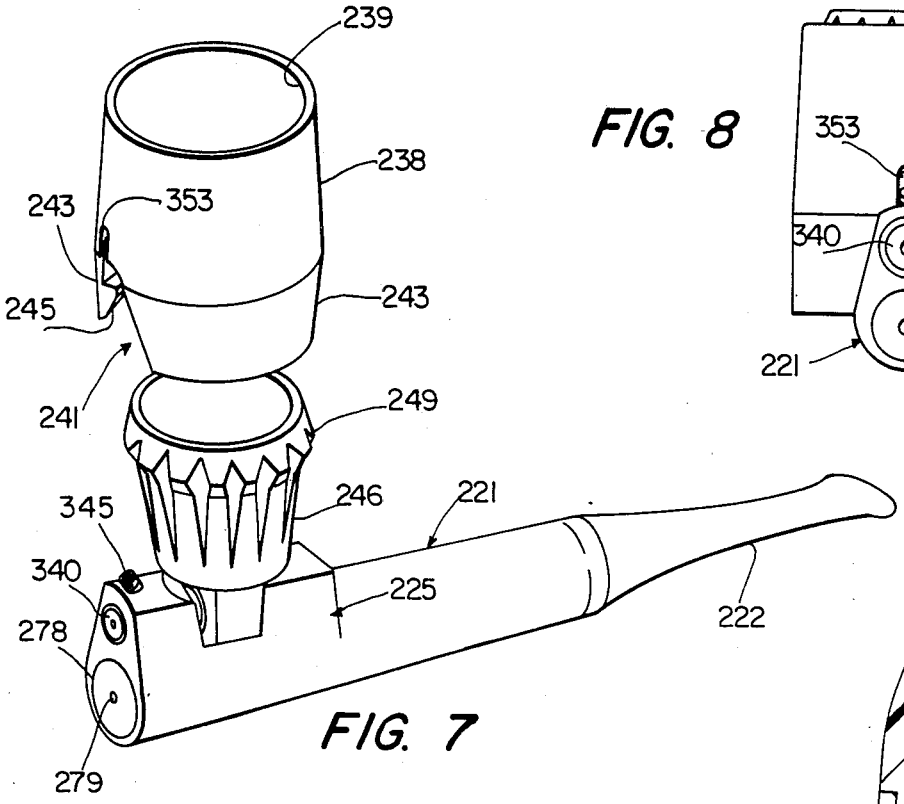
FIG. 7 is an exploded perspective view of the pipe of FIG. 6.
Figure 8:
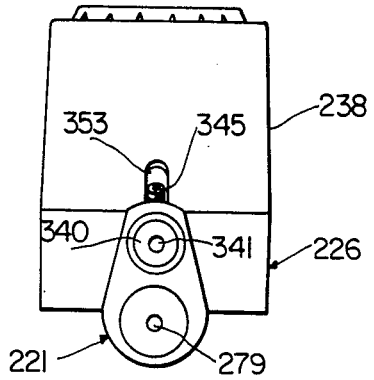
FIG. 8 is an end elevational view of the pipe of FIG. 6.

Pipe 220 provides a more attractive appearance and a lighter weight than pipe 20. In addition, it was found that excessive condensation collected in longitudinal passageway 64 beginning at the smoke hole or vertical passageway 66 rearwardly to the end of nipple 62. The condensation caused bitterness, a wet bite, and other general discomfort to the smoker. After discovery of the problem and upon realization of the cause of the problem, the solution was to provide either a minimum, diameter limitation of passageway 64 if a long passageway is desired as depicted in FIG. 3, or a significantly reduced length if desired as depicted for passageway 264 in FIG. 6. In addition, small foreign objects, such as tobacco particles lodged in the rearward portion of passageway 64. These particles resulted in an initial formation of condensation which rapidly grew to contaminate the passing smoke. Alternatively, the use of plenum at the end of the longitudinal passageway, such as plenum 465 in FIG. 10, discussed hereinbelow, also effectively shortened the longitudinal passageway while still permitting a wider base of inner bowl 46 (446 in FIG. 7).

Referring in particular to FIG. 6, pipe 220 comprises a chassis 221, a mouthpiece 222 removably attached to the rearward end of chassis 221 and a bowl assembly 226 attached to the forward, upper end of chassis 221. Chassis 221 includes a rearward stem 224 and a forwardly located bowl mounting assembly 225. Bowl assembly 226 includes a truncated, conical outer bowl 238 having a circumferential, inner flange 239 at the upward end thereof (as shown in FIG. 6). Outer bowl 238 is further provided with a longitudinal notch 241 defined by two lower skirts 243 and snap-on fastening means (e.g. boss 245) for frictional engagement with cooperating means (not shown) on the outside of mounting assembly 225. Bowl assembly 226 also includes a porcelain inner bowl 246 rigidly mounted between outer bowl flange 239 and mounting assembly 225. The top of outer bowl 236 projects above the top of outer bowl 238 so as to provide a heat and fire shield for outer bowl 238. Inner bowl 246 is provided with two coolings fins 248 located at a bottom thereof and a plurality of spaced apart cooling flanges 249 mounted around the upper periphery thereof. Cooling flanges 249 have a generally triangular shape in cross-section so as to provide both a cooling function and to provide an upper inclined surface for centering engagement with outer bowl flange 239.

A reflective coating 251 is provided on the inner surface of outer bowl 238 so as to promote a vertical flow of cooling air between inner bowl 246 and outer bowl 238.

As shown in FIG. 6, and as mentioned briefly above, inner bowl 246 is mounted on mounting assembly 225 of chassis 221. For this purpose, the longitudinal or horizontal passageway is provided with a rearwardly protruding nipple 262 and a forwardly protruding nipple 263 at respective ends thereof. A rearward O-ring 270 and a forward O-ring 271 provide fluid sealing engagement between nipples 262 and 263 and mounting assembly rear wall 258 and barrel screw 334, respectively. Therefore, by simply mounting outer bowl 238 onto mounting assembly 225 and tightening barrel screw 334, inner bowl 246 is firmly and rigidly mounted in place. In addition, mounting assembly 225 is provided with longitudinally spaced apart supports 254 which receive the bottom of cooling fins 248. Thus, a transverse cooling passageway is provided between cooling fins 248.

In the embodiment of inner bowl 246 depicted in FIG. 6, longitudinal passageway 264 is extremely short, having a length of only about $\frac{3}{8}$ of an inch. A typical diameter would be 0.156 inches (5/16 of an inch). Vertical passageway 266 on the other hand, is slightly longer than the embodiment depicted in FIG. 3. In the preferred embodiment in FIG. 6, the vertical passageway 266 has a length of 3/16 of an inch and a diameter of 0.140 inches (9/64 of an inch). Therefore, the effective ratio of vertical passageway 266 with the operative length of the horizontal passageway 264 (from vertical passageway 266 to the end of nipple 262) is about one-to-one.

Pipe 220 is also provided with an absorbent tube 74 mounted at its forward end on a modified plug 278. Plug 278 is threaded so as to be receivable in a correspondingly threaded orifice in stem 224 and has a hexagonal hole 279 for receiving a hex wrench. The other end of absorbent tube 274 is mounted on liquid passage tube 312 of a similar cluster assembly 308.

Mouthpiece 222 has a longitudinal bore 294 extending from a bit end 296 into a second phase cooling chamber 298. Chamber 298 is formed by an enlarged bore in the forward end of the mouthpiece 222. As seen in FIG. 6, chamber 298 has an arcuate upper wall 304 and is also provided with a lip 318 along the lower wall.

Disposed within the end of mouthpiece 222 into chamber 298 is a removable cluster assembly tube 308 comprised of a smoke tube 310 and a liquid passage tube 312. Smoke tube 310 extends forwardly and terminates in a vertically crimped, angled end 324. Two ovular side orifices 326 (only one of which is shown) are provided in the sides of smoke tube 310. Orifices 326 are not connected at the bottom, as in smoke tube 124 in FIG. 3, thereby requiring the smoke to divide into two flow paths. Smoke tube angled end 324 promotes the division of smoke into the two flows and the combined effect is to promote cooling and liquid separation. Furthermore, a reverse blast of air applied by this smoker at bit end 296 will emerge out the sides of smoke tube 324. This prevents liquid from being blown into longitudinal passageway 264. Finally, tobacco particles are effectively prevented from entering smoke tube 324, a condition that occasionally occurred before the end 324 of smoke tube 310 was crimped. This prevents liquid from being blown into longitudinal passageway 264.

It was found after use of pipe 20 depicted in FIG. 3 that liquid which had accumulated in passageway 64 tended to flow out jet plug bore 142. This problem is practically eliminated in pipe 220 of FIG. 6 by providing an inclined stack screw 345 having an internal bore 347. Through a corresponding opening 353 in outer bowl 238, fresh air can enter stack screw 345 and travel into threaded bore 336 of barrel screw 334. Jet plug 340 is provided with a circular recess 343 and internal bore 342 communication with recess 343. Thus, metered fresh air can be provided into the forward end of longitudinal passageway 264.

Stack screw 345 also serves the purpose of locking barrel screw 334 into position once it has been tightened against nipple 263. Jet plug 340 is also provided with a hexagonal hole 341 of the same size as hole 279 in plug 278. A fluid tight seal between jet plug 340 and barrel screw 334 is provided by an O-ring 351. It can thus be seen that jet plug 340 can be easily be removed for cleaning or for changing without effecting the loosening of barrel screw 334 and the dismounting of inner bowl 246.

Figure 9:
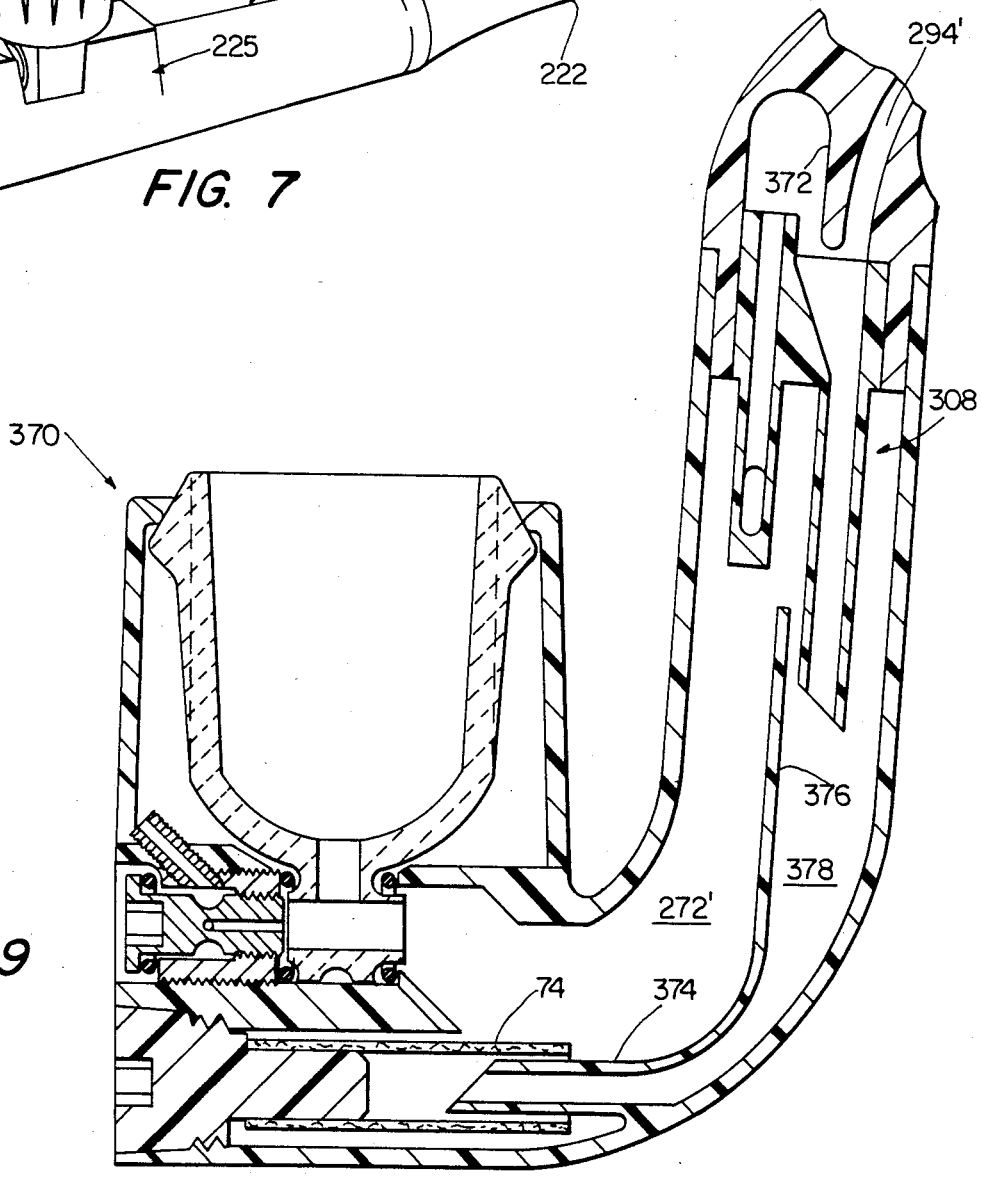
FIG. 9 is a side elevational view in cross-section of a full-bent model of the pipe of FIG. 6.

With reference now to FIG. 9, a bent-model of the pipe of FIG. 6 is depicted at 370. With a few exceptions, bent pipe 370 is identical to straight pipe 220. These exceptions include the location of cluster assembly 308 in the vertical portion of the pipe, thereby promoting moisture drainage and separation, a vertical partition 372 somewhat analogous to partition 106 of pipe 20 in FIG. 3, and a cylinder mounting nipple 374 having a corresponding inner wall extending as a flow partition 376. Vertical partition 372 promotes moisture separation by forcing the smoke to travel in an S-shaped flow path before entering stem bore 294'. Flow partition 376 insures the separation of bent pipe 370 into a smoke chamber 272 prime and a liquid chamber 378.

Figure 10:
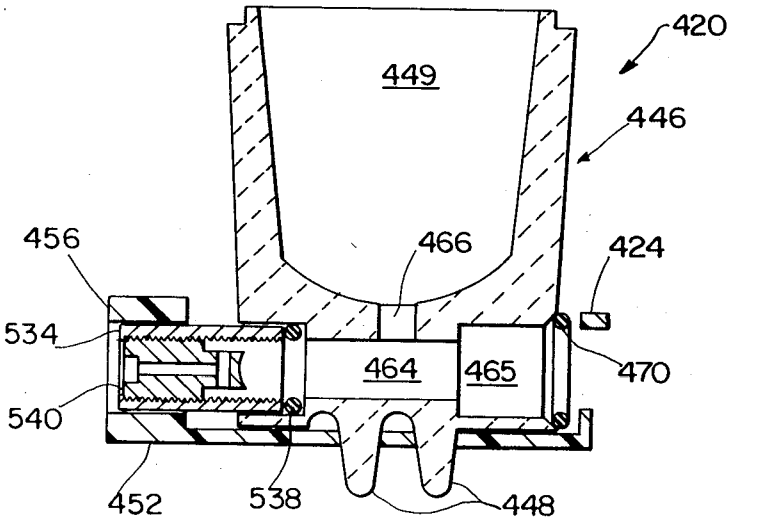
FIG. 10 is a side elevational view in cross-section of the ceramic bowl of yet another embodiment of the present invention.

Referring now to FIG. 10, the further embodiment of a pipe according to the present invention is depicted. This embodiment is denoted 420 and the corresponding elements to pipe 20 of FIG. 4 have a numerical value that is 400 greater than the numerical value of the elements in pipe 20.

Pipe 420 is provided wih an inner bowl 446 having a combustion chamber 449 and a vertical smoke hole 466. Smoke hole 466 communicates between combustion chamber 449 and a longitudinally extending passageway 464 which is open at the forward and rearward ends thereof. At the rearward end of longitudinal passageway 464 is a plenum 465. Plenum 465 serves effectively to terminate the length of longitudinal passageway 464 and thereby reduce moisture accumulation.

Pipe 420 has an air inlet system which is similar to that of pipe 20 and is also mounted similarly to support shank 452.

In a further embodiment, additional cooling can be obtained by providing an outer bowl 38 with additional orifices through it to supplement air passage openings 32.

Base ring 28 can also be provided with orifices. Preferably, the walls of the selected elements of bowl assembly 26 contain a large number of relatively small orifices spaced throughout the periphery in a geometrical design so that an aesthetically pleasing appearance is produced. The orifices can be produced by using an appropriately shaped, deep draft mold with hard surface cams for deep release after pressing each part. Alternatively, a collapsible mold having elements that extend through the material being moulded can be used.

From the foregoing, it can be appreciated that the present invention provides many distinct advantages and will result in a cool, flavorful smoke from beginning to end without the distasteful bite, foul taste, or unpleasant odors experienced in the past.

Inasmuch as the present invention is subject to many variations, modifications and changes in detail, it is intended that the foregoing description be interpreted as illustrative and not in a limiting sense.

I claim:

1. A smoker's pipe comprising:

a hollow stem having an enlarged cooling chamber therein;

a mouthpiece having a longitudinal bore therein and mounted on the rearward end of said stem; and a bowl assembly mounted onthe forward upper portion of said stem, said bowl assembly comprising a combustion bowl having walls which define an interior combustion chamber, the interior surface of said walls converging about a centrally located, axial bore, said bowl also having a passageway longitudinally extending completely through the bottom portion thereof below said combustion chamber and in communication with said axial bore and with said stem cooling chamber, the effective length of said longitudinal passageway being short with respect to the width of said combustion chamber and the diameter of said longitudinal passageway being smaller than the diameter of said stem cooling chamber.

2. A smoker's pipe as claimed in claim 1 wherein said longitudinal passageway has a length between said axial bore and said stem opening that is not longer than the length of said axial bore.

3. A smoker's pipe as claimed in claim 1 wherein said longitudinal passageway has the same diameter throughout from the forward end thereof to the rearward end thereof.

4. A smoker's pipe as claimed in claim 1 and further including a plenum located at the rearward end of said longitudinal passageway, said plenum being larger than and colinear with said longitudinal passageway.

5. A smoker's pipe as claimed in claim 1 and further including a means for rigidly mounting said combustion bowl to said stem about said passageway.

6. A smoker's pipe as claimed in claim 5 wherein said mounting means comprises a longitudinally extending member mounted in the forward part of said stem, the rearward portion of which engages the forward end of the wall defining said longitudinal passageway, and a means for providing a fluid tight seal between said member and said longitudinal passageway.

7. A smoker's pipe as claimed in claim 6 wherein said member is a hollow barrel screw; and said pipe further including ventilation means mounted in said barrel screw for providing fresh air into the forward end of said longitudinal passageway.

8. A smoker's pipe as claimed in claim 7 wherein said ventilation means comprises a removable air jet plug mountable inside said barrel screw, said jet plug having an internal longitudinal bore with a rearward opening, and a radial bore with a transverse opening, said radial bore in fluid communication with said longitudinal bore, and said ventilation means comprises a vertically extending orifice through said barrel screw which is in fluid communication with said radial bore.

9. A smoker's pipe as claimed in claim 8 wherein said ventilation means further includes a hollow stack screw mountable in said stem and extending into said barrel screw orifice in an inclined, forward direction, said stack screw when mounted for locking said barrel screw and for providing fluid communication from outside the pipe into said jet plug radial bore.

10. A smoker's pipe as claimed in claim 8 wherein said ventilation means further includes means for providing a fluid tight seal between said forward ends of said jet plug and said barrel screw; and wherein the jet plug is screwable into said barrel screw.

11. A smoker's pipe comprising:

a hollow stem having an enlarged cooling chamber therein at the forward end thereof;

a mouthpiece having a longitudinal bore therein and mounted on the rearward end of said stem; and a bowl assembly mounted on the forward upper portion of said stem, said bowl assembly comprising:

an outer bowl mounted on said stem, and an inner bowl mounted on said stem concentrically inside said outer bowl, said inner bowl having walls which define an interior combustion chamber, the interior surface of said walls converging about a centrally located, axial bore, said inner bowl also having a bottom portion located under said combustion chamber and having a longitudinal passageway therein, said longitudinal passageway being in fluid communication with said axial bore and, at the rearward end thereof, in fluid communication with said stem cooling chamber, the length of said longitudinal passageway from said axial bore to the rearward end thereof being not longer than the length of said axial bore and the diameter of said longitudinal passageway being smaller than the diameter of said stem cooling chamber.

12. A smoker's pipe as claimed in claim 11 wherein said outer bowl is comprised of a plastic material and said inner bowl is comprised of a ceramic material, the top of said inner bowl extending above the top of said outer bowl so as to provide a fire shield for said outer bowl.

13. A smoker's pipe as claimed in claim 12 and further including a reflective coating on the inner surface of said outer bowl.

14. A smoker's pipe as claimed in claim 11 wherein the top portion of said outer bowl is provided with an inward projecting flange for engaging with and centering a top portion of said inner bowl, and said inner bowl includes a plurality of axially extending, spaced apart ribs which engage, at the upper ends thereof, said outer bowl flange so as to provide a plurality of vertical cooling channels between said inner and outer bowls.

15. A smoker's pipe as claimed in claim 11 and further including snap-on securing means for removably securing said outer bowl to said stem.

16. A smoker's pipe as claimed in claim 11 and further including a cluster assembly mounted in said stem and having an upper smoke tube and a lower liquid tube, the forward end portion of said smoke tube being in fluid communication with said rearward end of said longitudinal passageway and the rearward end of said smoke tube being in fluid communication with said liquid tube and with the forward end of said mouthpiece bore; said smoke tube including a blocking means in the forward end thereof and an orifice in the side thereof in fluid communication with the interior thereof.

17. A smoker's pipe as claimed in claim 16 wherein said smoke tube blocking means comprises a solid, vertically extending wedge for dividing the smoke path into two parts, and said smoke tube comprises a second side orifice, located spaced from said first orifice on the opposite side of said smoke tube, each smoke tube orifice for providing fluid communication for a corresponding smoke path part with the interior of said smoke tube.

18. A smoker's pipe as claimed in claim 11 and further including means for removably mounting said outer bowl to said stem.

19. A smoker's pipe comprising:

a hollow stem;

a mouthpiece having a longitudinal bore therein; and a bowl assembly mounted on the forward upper portion of said stem, said bowl assembly comprising a combustion bowl having walls which define an interior combustion chamber, the interior surface of said walls converging about a centrally located, axial bore, said bowl also having a passageway longitudinally extending completely through the bottom portion thereof below said combustion chamber and in communication with said axial bore and with the interior of said stem, the length of said longitudinal passageway being short with respect to the width of said combustion chamber and wherein said combustion bowl has a forward hollow nipple at the forward end of said longitudinal bore and a rearward hollow nipple at the rearward, stem end of said longitudinal bore; and means for rigidly mounting said combustion bowl to said stem by said nipples.

20. A smoker's pipe as claimed in claim 19 wherein said combustion bowl mounting means includes a sealing means for proving a sealing connection between said rearward nipple and said stem.

21. A smoker's pipe as claimed in claim 20 wherein said mounting means includes a locking member removably mounted in the forward end of said stem for engaging said forward nipple, and includes a further sealing means for providing a sealing connection between said forward nipple and said locking member.

22. A smoker's pipe comprising:

an elongate hollow stem;

a mouthpiece having a longitudinal bore therein and mounted soley on the rearward end of said stem; and a bowl assembly mounted on the forward portion of said stem, said bowl assembly comprising an inner combustion bowl rigidly mounted on said stem, said combustion bowl having walls which define an exterior combustion chamber and having a bore through said walls in fluid communication with said chamber at one end and with the inside of said hollow stem at the other end, an outer bowl removably mounted on said stem independently from and concentrically spaced around said inner combustion bowl such that said outer bowl can be removed from said stem independently from said inner bowl without removing the rigidly mounted inner bowl, and means for removably mounting said outer bowl on said stem.

23. A smoker's pipe as claimed in calim 22 wherein said mounting means includes snap-on securing means for removably securing said outer bowl to said stem.

24. A smoker's pipe as claimed in claim 22 wherein said outer bowl is removably mounted on the forward upper portion of said stem and includes an upper, substantially cylindrical portion and a bottom skirt portion having a notch in opposed sides thereof, said notch having a size and shape conforming to the size and shape of said stem portion such that said notch can mountingly receive said stem portion.

25. A smoker's pipe as claimed in claim 24 wherein said outer bowl has a plurality of cooling orifices through the walls thereof.

* * * * *